US010618298B2

(12) United States Patent
Tamura et al.

(10) Patent No.: US 10,618,298 B2
(45) Date of Patent: Apr. 14, 2020

(54) LIQUID SUPPLY UNIT AND LIQUID INJECTION DEVICE

(71) Applicant: KYOCERA Document Solutions Inc., Osaka-shi (JP)

(72) Inventors: Yuki Tamura, Osaka (JP); Masaaki Maruta, Osaka (JP); Tomoya Hotani, Osaka (JP); Daisuke Eto, Osaka (JP); Ryo Matsuyama, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/363,035

(22) Filed: Mar. 25, 2019

(65) Prior Publication Data

US 2019/0291448 A1 Sep. 26, 2019

(30) Foreign Application Priority Data

Mar. 26, 2018 (JP) ..... 2018-057909

(51) Int. Cl.
*B41J 2/175* (2006.01)

(52) U.S. Cl.
CPC ..... *B41J 2/17523* (2013.01); *B41J 2/17509* (2013.01); *B41J 2/17556* (2013.01); *B41J 2/17596* (2013.01)

(58) Field of Classification Search
CPC ..... B41J 2/17596; B41J 2/17509; B41J 2/17556; B41J 2/17523
USPC ..... 347/84–86
See application file for complete search history.

(56) References Cited

U.S. PATENT DOCUMENTS

| | | | | |
|---|---|---|---|---|
| 9,327,513 | B2 * | 5/2016 | Moriguchi | B41J 2/175 |
| 9,623,669 | B2 * | 4/2017 | Kato | B41J 2/055 |
| 9,855,760 | B2 * | 1/2018 | Sato | B41J 2/1652 |
| 10,160,225 | B2 * | 12/2018 | Koike | B41J 2/17509 |
| 2005/0073559 | A1 | 4/2005 | Aruga et al. | |

FOREIGN PATENT DOCUMENTS

WO 03/041964 5/2003

* cited by examiner

*Primary Examiner* — An H Do
(74) *Attorney, Agent, or Firm* — Gerald E. Hespos; Michael J. Porco; Matthew T. Hespos

(57) ABSTRACT

A liquid supply unit includes a first chamber, a second chamber, a wall portion, an opening/closing member, a flexible film member and a transmitting member. The wall portion includes a communication opening allowing communication between the first chamber and the second chamber. The opening/closing member changes a posture between a closing posture for closing the communication opening from the second chamber side and an opening posture. The flexible film member is displaced based on a pressure change of the second chamber. The transmitting member transmits a displacement force to the opening/closing member to be the opening posture when the second chamber is set to a negative pressure exceeding a predetermined threshold value, and transmits the displacement force to the opening/closing member to be the closing posture according to a displacement of the flexible film member when the second chamber is pressurized.

4 Claims, 13 Drawing Sheets

LIQUID SUPPLY UNIT AND LIQUID INJECTION DEVICE

INCORPORATION BY REFERENCE

This application is based on Japanese Patent Application No. 2018-57909 filed with the Japan Patent Office on Mar. 26, 2018, the contents of which are hereby incorporated by reference.

BACKGROUND

The present disclosure relates to a liquid supply unit for supplying liquid stored in a liquid storage container to a liquid injection head and a liquid injection device to which the liquid supply unit is applied.

For example, in an ink jet printer, a liquid injection head for injecting a tiny amount of ink (liquid) to a print object is used. Ink is supplied to this liquid injection head from an ink cartridge (liquid storage container) storing the ink through a predetermined supply passage. Conventionally, a liquid injection device is known in which a liquid supply unit (valve unit) including a pressure chamber for setting a discharge hole of a liquid injection head to a negative pressure is arranged in a supply passage in the case of supplying ink from an ink cartridge to the liquid injection head by a water head difference. By disposing the liquid supply unit for generating the negative pressure, unlimited dripping of the ink from the discharge hole is suppressed even if the ink is supplied by the water head difference.

A conventional liquid supply unit adopts such a structure that a part of a pressure chamber set to a negative pressure is defined by a flexible film and a pressing plate (pressure receiving plate) attached to this flexible film directly presses a movable valve. The movable valve is biased in a direction opposite to a direction of the pressing by a biasing member. If a negative pressure degree of the pressure chamber increases due to the suction of ink by the liquid injection head, the movable valve is pressed against the pressing plate to move according to a displacement of the flexible film, an ink supply passage into the pressure chamber is opened and the ink flows into the pressure chamber. If the negative pressure degree of the pressure chamber decreases due to this inflow of the ink, the movable valve is moved in a reverse direction by a biasing force of the biasing member and the pressure chamber returns to a sealed state.

SUMMARY

A liquid supply unit according to one aspect of the present disclosure supplies predetermined liquid from a liquid storage container storing the liquid to a liquid injection head for injecting the liquid. The liquid supply unit includes a first chamber, a second chamber, a wall portion, an opening/closing member, a flexible film member and a transmitting member. The first chamber communicates with the liquid storage container. The second chamber is arranged downstream of the first chamber in a liquid supply direction and communicates with the liquid injection head. The wall portion includes a communication opening allowing communication between the first chamber and the second chamber. The opening/closing member is arranged to be able to open and close the communication opening from the second chamber side and changes a posture between a closing posture for closing the communication opening and an opening posture for opening the communication opening. The flexible film member defines a side surface of the second chamber facing the communication opening and is displaced based on a pressure change of the second chamber. The transmitting member transmits a displacement force of the flexible film member to the opening/closing member in a direction opposite to a displacement direction of the flexible film member. The transmitting member transmits the displacement force to the opening/closing member to set the opening/closing member to the opening posture when the second chamber is set to a negative pressure exceeding a predetermined threshold value as the liquid in the second chamber decreases, and transmits the displacement force to the opening/closing member to set the opening/closing member to the closing posture according to a displacement of the flexible film member when the second chamber is pressurized.

Further, a liquid injection device according to another aspect of the present disclosure includes a liquid injection head configured to inject predetermined liquid, the above liquid supply unit configured to supply the liquid from a liquid storage container storing the liquid to the liquid injection head, a first supply passage allowing communication between the liquid storage container and the first chamber of the liquid supply unit, and a second supply passage allowing communication between the liquid injection head and the second chamber of the liquid supply unit.

DETAILED DESCRIPTION

Overall Configuration of Printer

Figure 1:
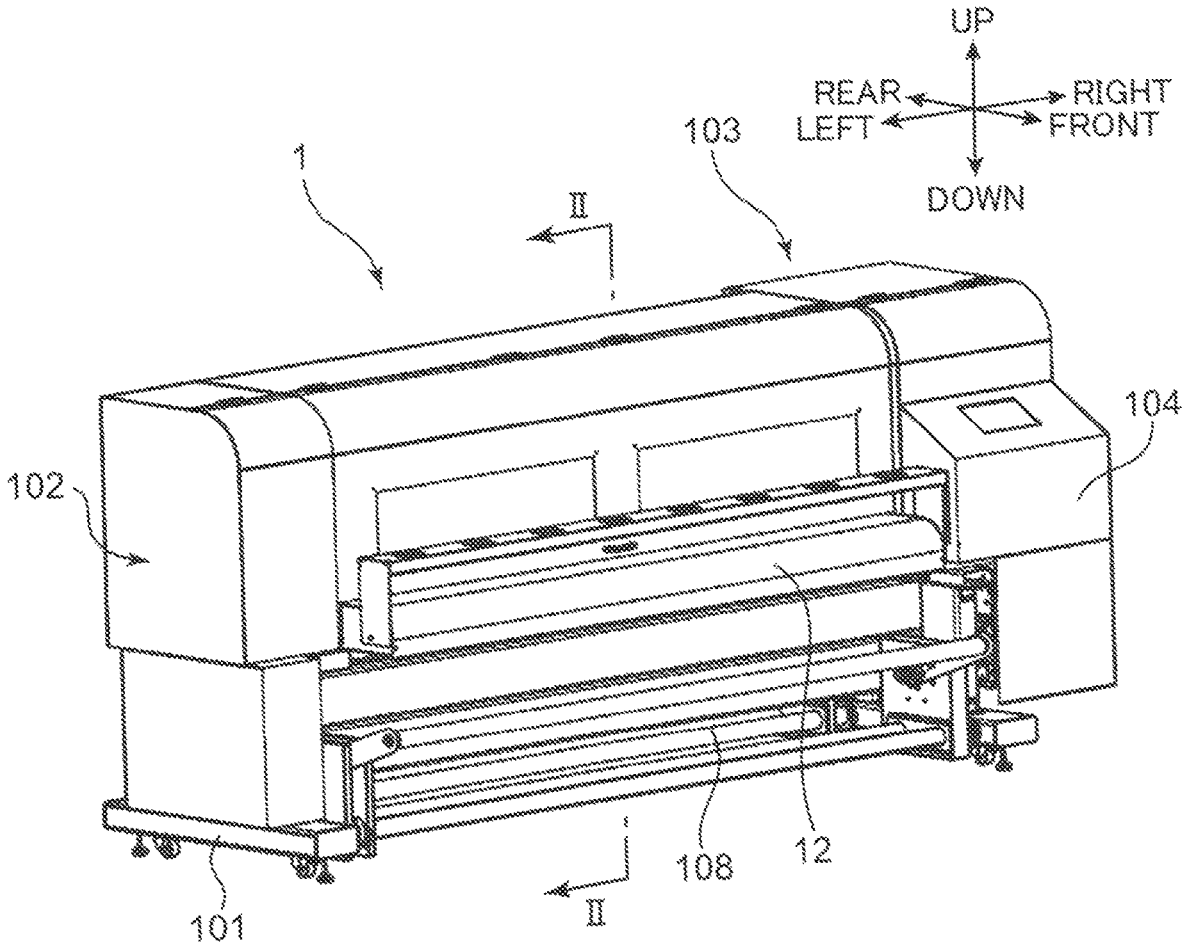
FIG. 1 is a perspective view showing the external appearance of an ink jet printer to which the present disclosure is applied.
Figure 2:
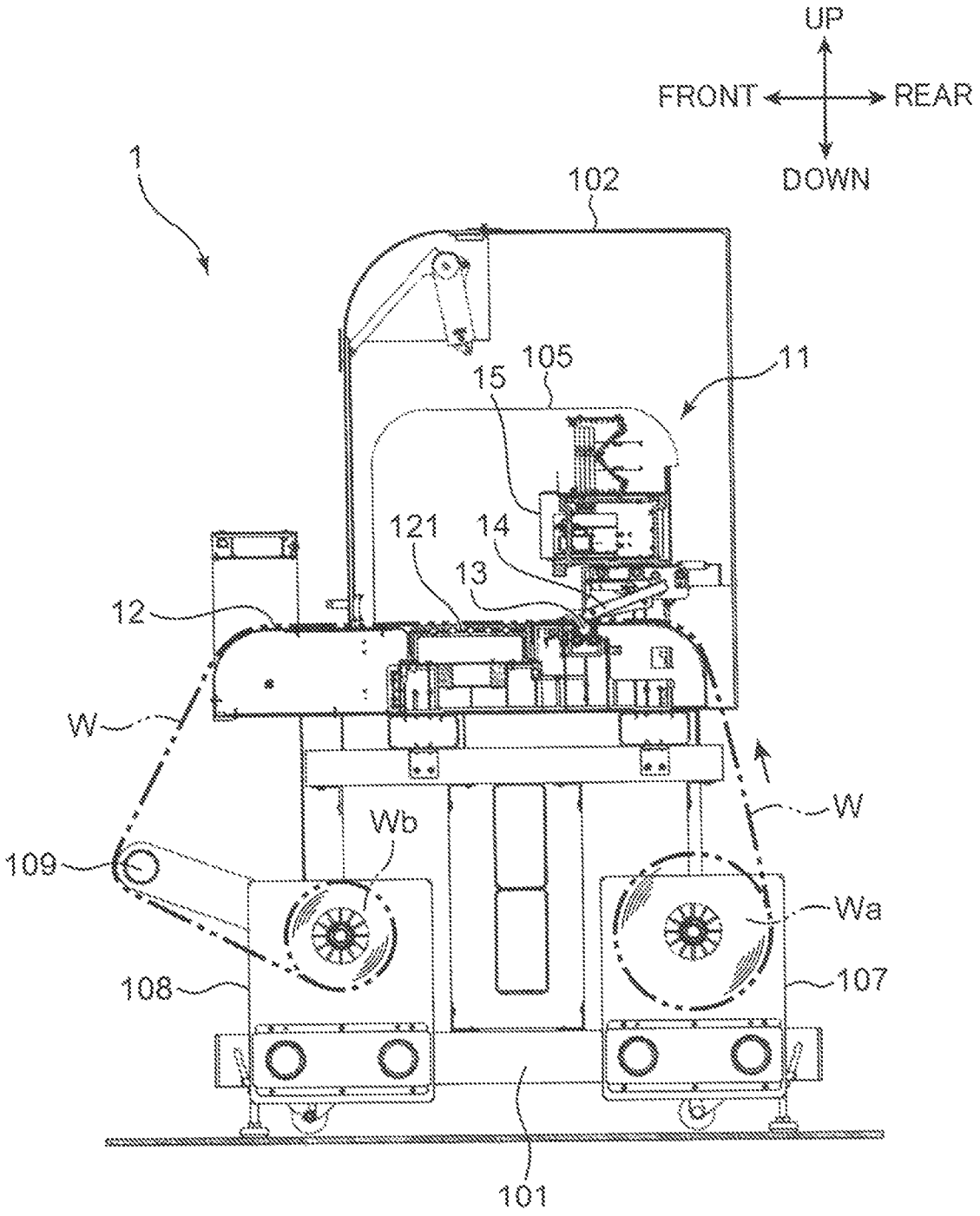
FIG. 2 is a sectional view along line II-II of FIG. 1.
Figure 3:
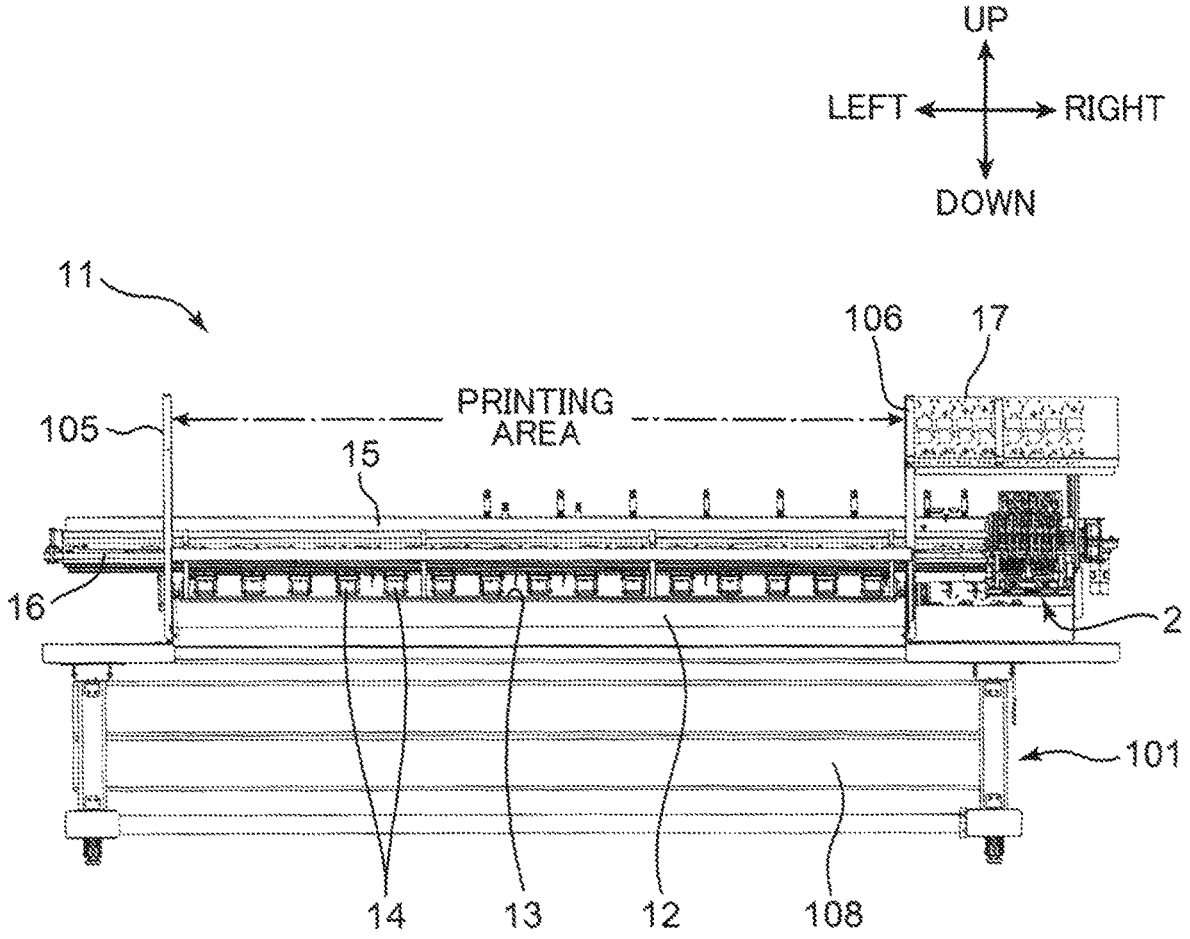
FIG. 3 is a front view of the ink jet printer with an outer cover removed.

Hereinafter, one embodiment of the present disclosure is described with reference to the drawings. First, an ink jet printer to which a liquid supply unit or a liquid injection device according to the present disclosure is applied is described. FIG. 1 is a perspective view showing the external appearance of an ink jet printer 1 according to the embodiment, FIG. 2 is a sectional view along line II-II of FIG. 1, and FIG. 3 is a front view of the printer 1 with an outer cover 102 removed. Note that front-rear, lateral and vertical directions are indicated in FIGS. 1 to 3 and figures described later, but this is only for the convenience of description and not intended to limit directions at all.

The printer 1 is a printer for performing a printing process of printing characters and images on various works W such as paper sheets, resin sheets or cloth fabrics, and particularly a printer suitable for a printing process on large-size and long works. The printer 1 includes a base frame 101 with casters and an apparatus body 11 placed on the base frame 101 and configured to perform the printing process.

The apparatus body 11 includes a work conveyance path 12, a conveyor roller 13, pinch roller units 14 and a carriage 2. The work conveyance path 12 is a conveyance path extending in a front-rear direction for loading a work W, to which the printing process is applied, into the apparatus body 11 from a rear side and unloading the work W from a front side. The conveyor roller 13 is a roller extending in a lateral direction and configured to generate a drive force for intermittently feeding the work W along the work conveyance path 12. The pinch roller unit 14 is arranged to face the conveyor roller 13 from above and includes a pinch roller which forms a conveyance nip together with the conveyor roller 13. A plurality of the pinch roller units 14 are arranged at predetermined intervals in the lateral direction.

The carriage 2 is a movable body on which units for performing the printing process on the work W are mounted and which can reciprocate along the lateral direction on the base frame 101. A carriage guide 15 with a guide rail for guiding reciprocal movements of the carriage 2 stands to extend in the lateral direction on a rear side of the base frame 101. A timing belt 16 is so assembled with the carriage guide 15 as to be able to circulate in the lateral direction. The carriage 2 includes a fixing portion for the timing belt 16, and moves in the lateral direction while being guided by the guide rail as the timing belt 16 circulates in a forward or reverse direction.

The printing process is performed by intermittently feeding the work W by the conveyor roller 13 and the pinch roller units 14 and moving the carriage 2 in the lateral direction while the work W is stopped to print and scan the work W. Note that, in the work conveyance path 12, a platen 121 (see FIG. 2) additionally provided with a function of sucking the work W is arranged below a passage path of the carriage 2. During the printing process, the carriage 2 performs printing and scanning with the work W sucked to the platen 121.

The apparatus body 11 is covered by an outer cover 102. A side station 103 is arranged in a region to the right of the outer cover 102. An immovable ink cartridge shelf 17 for holding ink cartridges IC (FIGS. 5 and 6) for storing ink (predetermined liquid) for the printing process is housed in the side station 103.

A carriage retraction area 104 serving as a retraction space for the carriage 2 is present in a front part of the side station 103. As shown in FIG. 3, a left frame 105 and a right frame 106 stand on the base frame 101 while being spaced apart in the lateral direction by a distance corresponding to the work conveyance path 12. An area between these left and right frames 105, 106 serves as a printing area where the printing process can be performed. The carriage guide 15 has a lateral width longer than the printing area, and the carriage 2 is movable to a right outer side of the printing area. When the printing process is not performed, the carriage 2 is retracted to the carriage retraction area 104. Further, a pressurized purge process to be described later is also performed in this carriage retraction area 104.

A feeding unit 107 housing a feed roll Wa, which is a winding body of the work W having the printing process applied thereto, is provided on a rear side of the base frame 101. Further, a winding unit 108 housing a winding roll Wb, which is a winding body of the work W after the printing process, is provided on a front side of the base frame 101. The winding unit 108 includes an unillustrated drive source for rotationally driving a winding shaft of the winding roll Wb, and winds the work W while applying predetermined tension to the work W by a tension roller 109.

Configuration of Carriage

Figure 4:
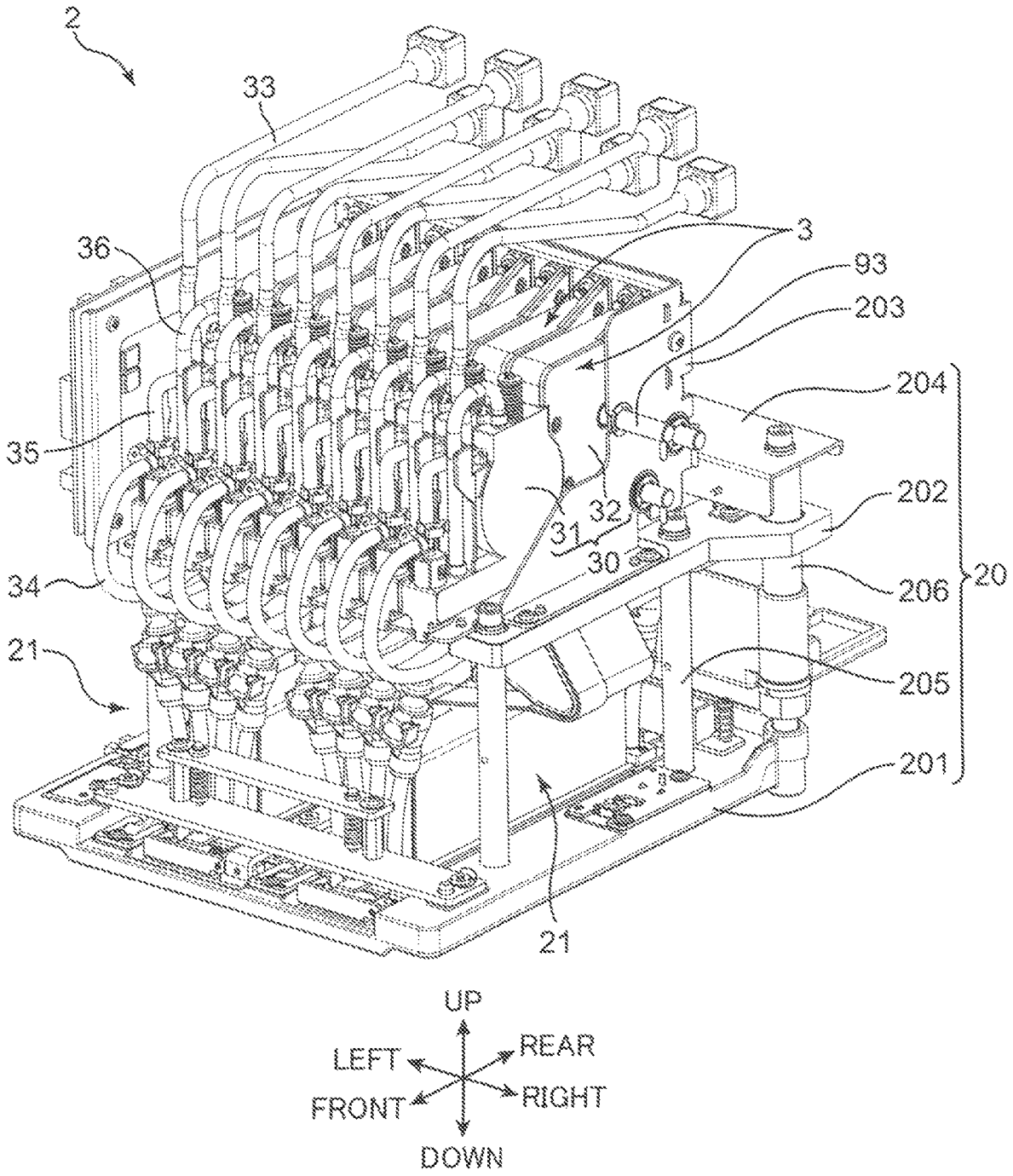
FIG. 4 is an overall perspective view of a carriage mounted in the ink jet printer.

FIG. 4 is an overall perspective view of the carriage 2. Head units 21 (liquid injection heads) for injecting the ink (liquid) to the work W and liquid supply units 3 for supplying the ink from the ink cartridges IC to the head units 21 are mounted on the carriage 2. FIG. 4 shows an example in which two head units 21 and eight liquid supply units 3 are mounted on the carriage 2. Specifically, four liquid supply units 3 are equipped for each head unit 21 to supply respective inks of cyan, magenta, yellow and black. Note that the ink of a different color is filled into each liquid supply unit 3, and inks of at most eight colors may be injected from the two head units 21.

The carriage 2 includes the head units 21 and a carriage frame 20 for holding the head units 21. The carriage frame 20 includes a lower frame 201 located at a lowermost position, an upper frame 202 arranged above and at a distance from the lower frame 201, a rack 203 mounted on the upper surface of the upper frame 202 and a back surface frame 204 mounted on the rear surface of the upper frame 202. The lower frame 201 and the upper frame 202 are coupled by coupling support columns 205 extending in the vertical direction. An unillustrated ball screw mechanism is mounted on the back surface frame 204, and a nut portion driven by that ball screw is mounted on the lower frame 201. Further, the back surface frame 204 is provided with guiding support columns 206 extending in the vertical direction. By the drive of the ball screw mechanism, a coupled body of the lower frame 201 and the upper frame 202 can move in the vertical direction while being guided by the guiding support columns 206. That is, a body part of the carriage 2 is movable in the vertical direction with respect to the back surface frame 204.

The head units 21 are mounted on the lower frame 201. Since the body part of the carriage 2 is movable in the vertical direction as described above, vertical height positions of the head units 21 with respect to the work W are adjustable. The liquid supply units 3 are mounted on the upper frame 202. The eight liquid supply units 3 are supported on the upper frame 202 while being aligned in the lateral direction in the rack 203. A guided portion to be guided by the guide rail of the carriage guide 15, a fixing portion to the timing belt 16 and the like are provided on the back surface frame 204.

Figure 5:
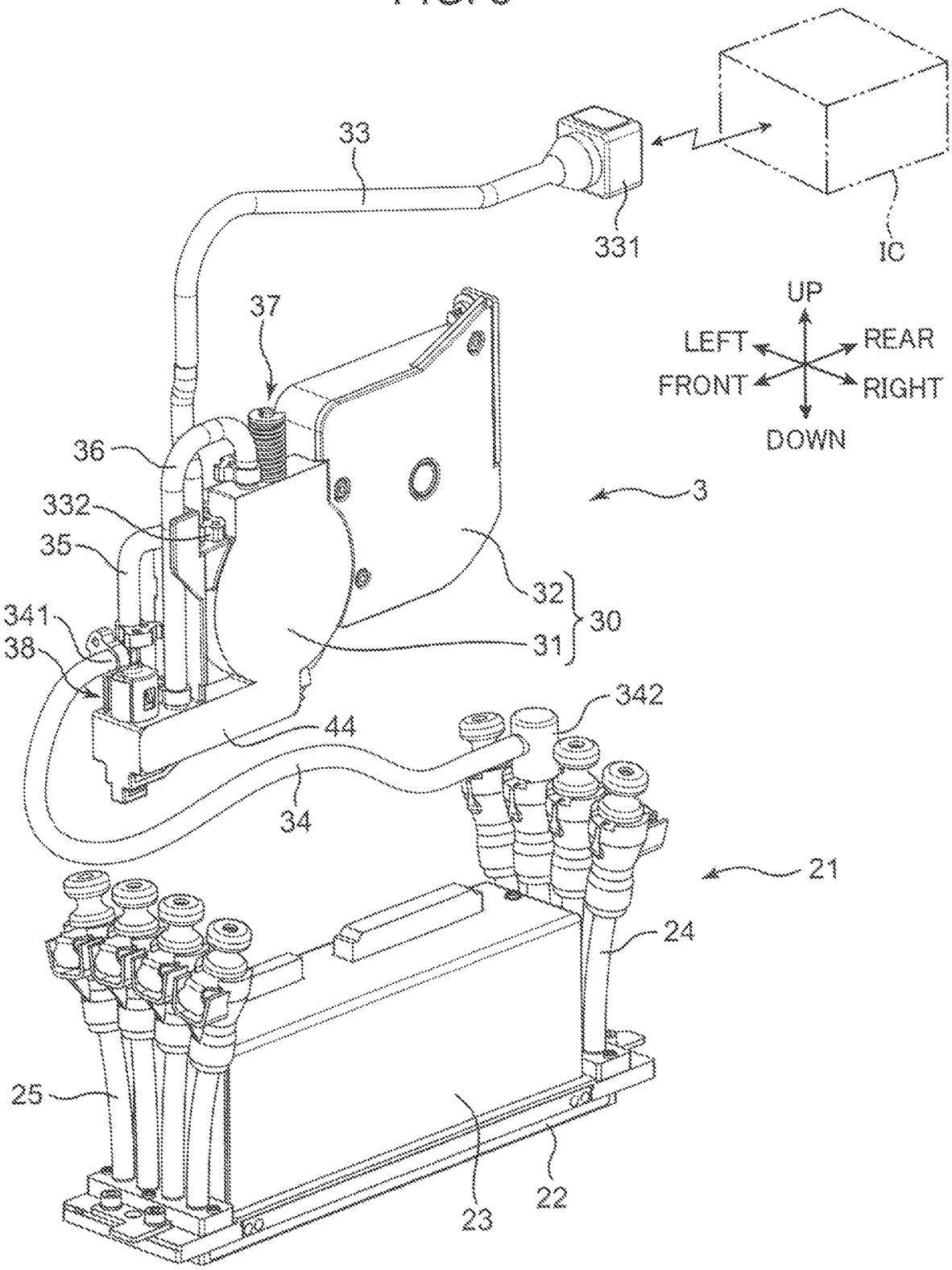
FIG. 5 is a perspective view showing one liquid supply unit and one head unit.

FIG. 5 is a perspective view showing one liquid supply unit 3 and one head unit 21. The liquid supply unit 3 includes a body portion 30 with a tank portion 31 and a pump portion 32, an upstream pipe 33 (first supply passage) arranged on an upstream side of the body portion 30 in an ink supply direction (liquid supply direction), a downstream pipe 34 (second supply passage) arranged on a downstream side of the body portion 30, and a bypass pipe 35. The tank portion 31 is a region forming a space for temporarily storing the ink to be supplied to the head unit 21 under a negative pressure environment. The pump portion 32 is a region for housing a pump 9 (FIG. 6) to be operated during a decompression process for forming the negative pressure environment and a pressurized purge process for cleaning the head unit 21 (ink discharging portion 22).

The upstream pipe 33 is a supply pipe allowing communication between the tank portion 31 and the ink cartridge IC (liquid storage container). An upstream end 331 of the upstream pipe 33 is connected to a terminal end part of a tube (not shown) extending from the ink cartridge IC, and a downstream end 332 is connected to an inlet part of the tank portion 31. The downstream pipe 34 is a supply pipe allowing communication between the tank portion 31 and the head unit 21. An upstream end 341 of the downstream pipe 34 is connected to an outlet part of the tank portion 31 and a downstream end 342 is connected to the head unit 21. The bypass pipe 35 is a conduit for feeding the ink to the downstream pipe 34 without via the negative pressure environment (second chamber 42 to be described later) of the tank portion 31.

The head unit 21 includes the ink discharging portion 22, a control unit 23, an end tube 24 and a discharge tube 25. The ink discharging portion 22 is a nozzle part for discharging ink droplets toward the work W. A piezo method using a piezo element, a thermal method using a heating element or the like can be adopted as a method for discharging ink droplets in the ink discharging portion 22. The control unit 23 includes a control board for controlling the piezo element or the heating element provided in the ink discharging portion 22 and controls an operation of discharging ink droplets from the ink discharging portion 22.

The end tube 24 is a tube linking the downstream end 342 of the downstream pipe 34 and the ink discharging portion 22. The downstream end 342 is a cap-type socket and attachable to an upper end fitting part of the end tube 24 in a single operation. The discharge tube 25 is a tube for discharging preservation solution sealed in the liquid supply unit 3 during initial usage. During initial usage, the downstream end 342 of the downstream pipe 34 is attached to the upper end fitting part of the end tube 24 and the discharge tube 25 is connected to the liquid supply unit 3 via a separate tube to open a storage space for the preservation solution, whereby an operation of discharging the preservation solution is performed.

Summary of Liquid Supply System

In this embodiment, the device is configured such that the ink cartridge IC is arranged above the head unit 21 and the ink is supplied to the head unit 21 by a water head difference. In the case of supplying the ink by the water head difference, the ink is constantly discharged from the ink discharging portion 22 of the head unit 21 if the ink is supplied at normal pressure. Thus, it is necessary to dispose a negative pressure generating portion for generating a negative pressure environment in the ink supply path and set the ink discharging portion 22 to a suitable negative pressure. The tank portion 31 of the liquid supply unit 3 functions as the above negative pressure generating portion.

Figure 6:
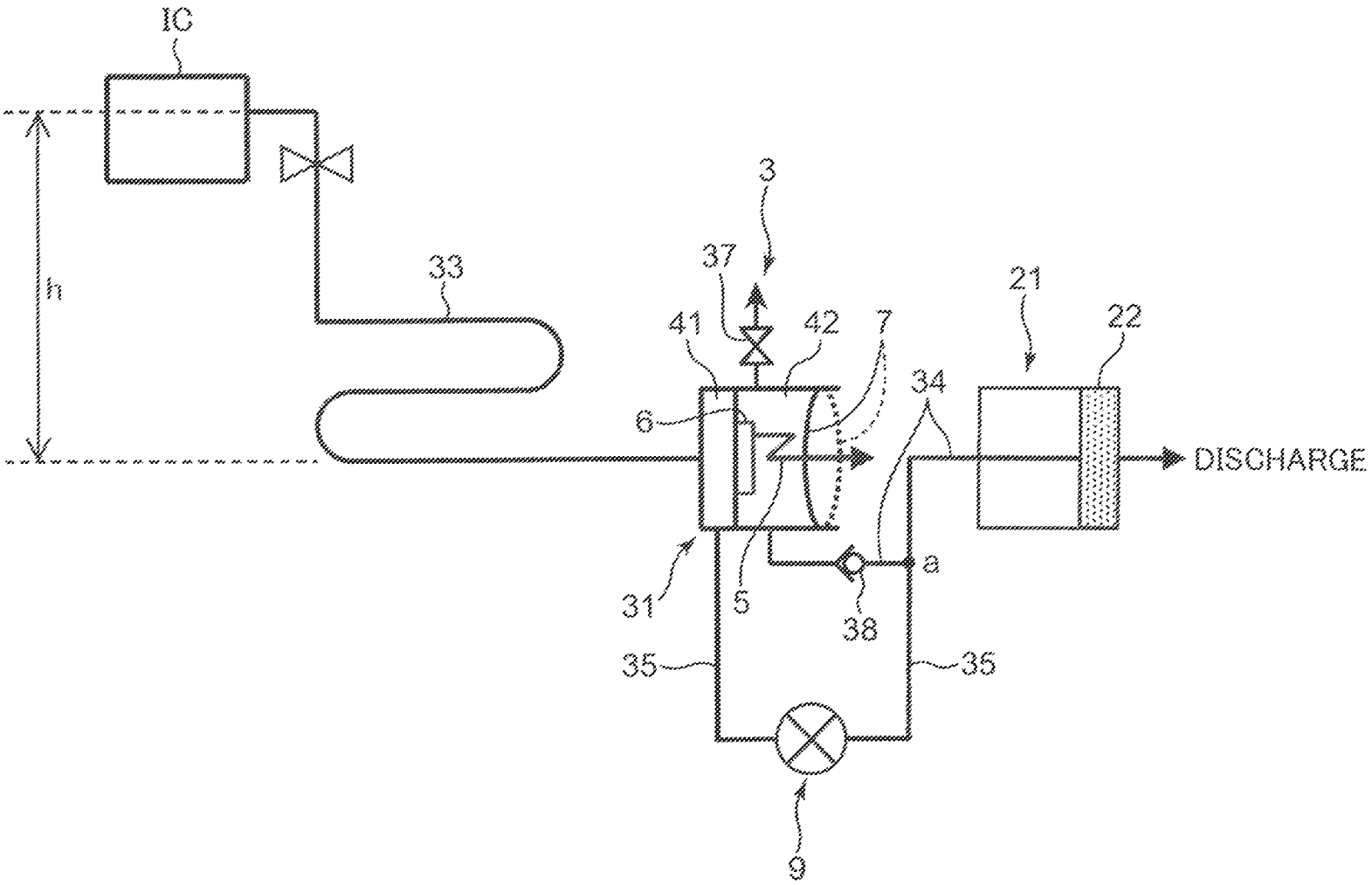
FIG. 6 is a block diagram showing a liquid supply system in an embodiment showing a state where a print mode is being performed.

FIG. 6 is a block diagram schematically showing the liquid supply system adopted in the carriage 2 of this embodiment. The ink cartridge IC is arranged at a position higher than the ink discharging portion 22 by a height h. This height h serves as the water head difference and the ink in the ink cartridge IC is supplied to the head unit 21 by this water head difference. The liquid supply unit 3 is incorporated at an intermediate position of the ink supply path between the ink cartridge IC and the head unit 21. The tank portion 31 of the liquid supply unit 3 includes a first chamber 41 set to a pressure (first pressure) higher than an atmospheric pressure by receiving the water head difference and the second chamber 42 arranged downstream of the first chamber 41 in the ink supply direction and set to a negative pressure (second pressure decompressed from the first pressure). The first chamber 41 is a chamber in which a negative pressure operation is not performed and to which a pressure P by the water head difference is applied in addition to the atmospheric pressure. This pressure P is expressed by $P=\rho gh$ [Pa] when $\rho$ denotes water density (ink can be handled equivalent to water in density), g denotes a gravitational acceleration and h denotes the water head difference. The first chamber 41 communicates with the ink cartridge IC via the upstream pipe 33. The second chamber 42 communicates with the ink discharging portion 22 via the downstream pipe 34.

An on-off valve 6 coupled to a transmitting member 5 is arranged on a wall surface partitioning between the first chamber 41 and the second chamber 42. Further, a wall portion defining the second chamber 42 is partially constituted by an atmospheric pressure detection film 7 (flexible film member). When a pressure in the second chamber 42 reaches a negative pressure exceeding a predetermined threshold value, the atmospheric pressure detection film 7 detects the atmospheric pressure to be displaced. This displacement force is applied to the transmitting member 5, a posture of the on-off valve 6 coupled to the pressing member 5 changes from a closing posture to an opening posture, and the first chamber 41 and the second chamber 42 are allowed to communicate. An ink supply route during a normal printing process is a route passing through the upstream pipe 33, the first chamber 41, the second chamber 42 and the downstream pipe 34. In addition to this, the bypass pipe 35 for short-circuiting the first chamber 41 and the downstream pipe 34 without via the second chamber 42 is provided. The pump 9 capable of rotating in forward and reverse rotation directions is arranged in the bypass pipe 35.

FIG. 6 is also a diagram showing a state where the liquid supply system is performing a print mode (during normal liquid supply) for performing the printing process. In the print mode, a predetermined amount of the ink is filled in each of the first and second chambers 41, 42 and the second chamber 42 is set to a predetermined negative pressure. The pressure in the first chamber 41 is the atmospheric pressure+$\rho gh$ [Pa] due to the water head difference as described above and the ink can be supplied from the ink cartridge IC by the water head difference any time. As basic setting of the print mode, the on-off valve 6 is set in the closing posture and the first and second chambers 41, 42 are separated. The pump 9 is in a stopped state. Although described later, the pump 9 is a tube pump and the bypass pipe 35 is in a closed state when the pump 9 is stopped. Thus, the downstream pipe 34 and the ink discharging portion 22 are also maintained at the negative pressure.

To smoothly fill the ink into the second chamber 42, an air vent mechanism 37 is attached to the second chamber 42. A predetermined amount of the ink needs to be initially filled into the second chamber 42 during initial usage, after maintenance and the like. The air vent mechanism 37 promotes the initial filling by allowing the second chamber 42 set in the negative pressure environment to temporarily communicate with the atmosphere (by venting air in the second chamber 42). Further, the ink stored in the second chamber 42 may generate air bubbles by heating. The air vent mechanism 37 is also used in removing air based on the air bubbles from the second chamber 42.

When the head unit 21 operates and the ink discharging portion 22 discharges ink droplets, the ink in the second chamber 42 is consumed and, accordingly, a degree of the negative pressure in the second chamber 42 progresses. That is, the ink discharging portion 22 sucks the ink from the second chamber 42 in a state separated from the atmosphere and enhances a negative pressure degree of the second chamber 42 every time discharging ink droplets. When the pressure in the second chamber 42 reaches a negative pressure exceeding the predetermined threshold value as the ink in the second chamber 42 decreases, the atmospheric pressure detection film 7 detects the atmospheric pressure to be displaced as described above. By this displacement force, the posture of the on-off valve 6 changes from the closing posture to the opening posture through the transmitting member 5 and the first and second chambers 41, 42 communicate. Thus, the ink flows from the first chamber 41 into the second chamber 42 due to a pressure difference between the both chambers.

As the ink flows into the second chamber 42, the negative pressure degree of the second chamber 42 is gradually alleviated and approaches the atmospheric pressure. Simultaneously, the displacement force applied to the transmitting member 5 from the atmospheric pressure detection film 7 also becomes gradually smaller. When the pressure in the second chamber 42 reaches a negative pressure below the predetermined threshold value, the posture of the on-off valve 6 returns to the closing posture and the first and second chambers 41, 42 are separated again. At this time, the ink is replenished into the first chamber 41 from the ink cartridge IC by the water head difference by an amount flowed into the second chamber 42 from the first chamber 41. In the print mode, such an operation is repeated.

The liquid supply system of this embodiment is capable of performing the pressurized purge mode and a decompression mode in addition to the above print mode. The pressurized purge mode is a mode for supplying high-pressure ink to the ink discharging portion 22 and causing the ink discharging portion 22 to discharge the ink in order to recover or prevent ink clogging. The decompression mode is a mode for setting the second chamber 42 at normal pressure to the predetermined negative pressure during initial usage, after maintenance and the like.

Figure 7A:
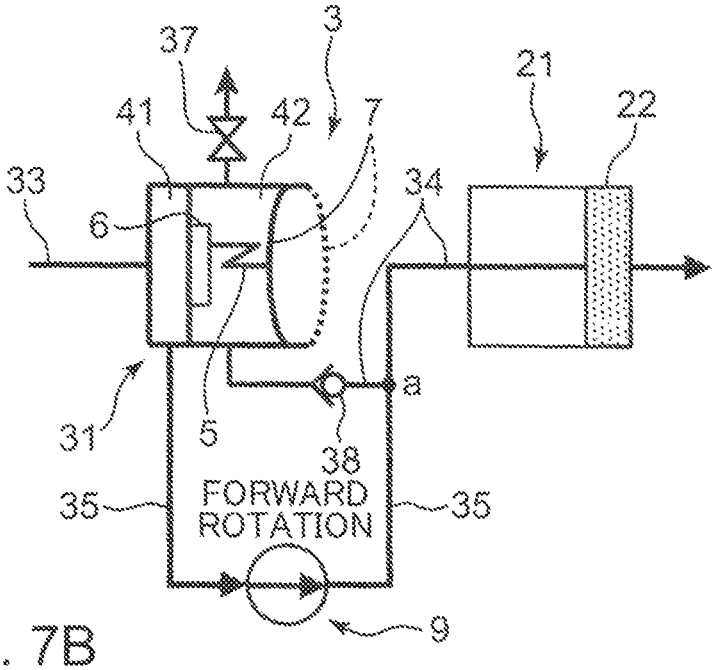
FIG. 7A is a diagram showing a state where a pressurized purge mode is being performed.

FIG. 7A is a diagram showing a state where the pressurized purge mode is being performed. In the pressurized purge mode, the pump 9 is driven in the forward rotation direction. By the forward drive of the pump 9, the ink directly moves from the upstream pipe 33 toward the downstream pipe 34 via the first chamber 41 and the bypass pipe 35 while bypassing the second chamber 42. That is, the ink pressurized in the pump 9 is supplied to the ink discharging portion 22. In this way, the ink is forcibly discharged from the ink discharging portion 22 to clean the ink discharging portion 22. Note that an operation similar to that in the pressurized purge mode is also performed when the preservation solution sealed in the liquid supply unit 3 is discharged during initial usage.

A backflow prevention mechanism 38 is provided to prevent the pressurized ink from flowing back to the second chamber 42 through the downstream pipe 34 when the pressurized purge mode is performed. The backflow prevention mechanism 38 is arranged in the downstream pipe 34 on a side upstream of a joint part a of the downstream pipe 34 and a downstream end of the bypass pipe 35. Since a side of the downstream pipe 34 upstream of the joint part a is closed by the backflow prevention mechanism 38, all the high-pressure ink generated in the bypass pipe 35 flows toward the ink discharging portion 22. Thus, the breakage of the atmospheric pressure detection film 7 defining the second chamber 42 is prevented.

Figure 7B:
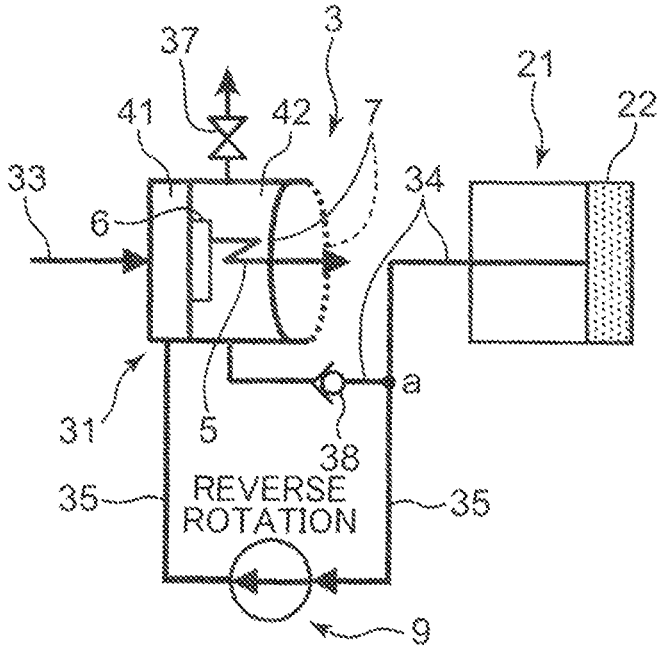
FIG. 7B is a diagram showing a state where a decompression mode is being performed.

FIG. 7B is a diagram showing a state where the decompression mode is being performed. In the decompression mode, the pump 9 is driven in the reverse rotation direction. When the pump 9 is driven in the reverse rotation direction, the ink discharging portion 22 and the second chamber 42 are decompressed through the downstream pipe 34 and the bypass pipe 35. The ink discharging portion 22 and the second chamber 42 are set to a predetermined negative pressure, i.e. a negative pressure at which ink droplets do not leak from the ink discharging portion 22 even if the ink is supplied by the water head difference, by this decompression mode. Note that if the ink discharging portion 22 is set to an excessive negative pressure, ink discharge by the drive of the piezo element or the like in the ink discharging portion 22 may be impeded. Thus, the ink discharging portion 22 and the second chamber 42 are desirably set, for example, to a weak negative pressure of about −0.2 to −0.7 kPa.

Overall Structure of Liquid Supply Unit

Figure 8C:
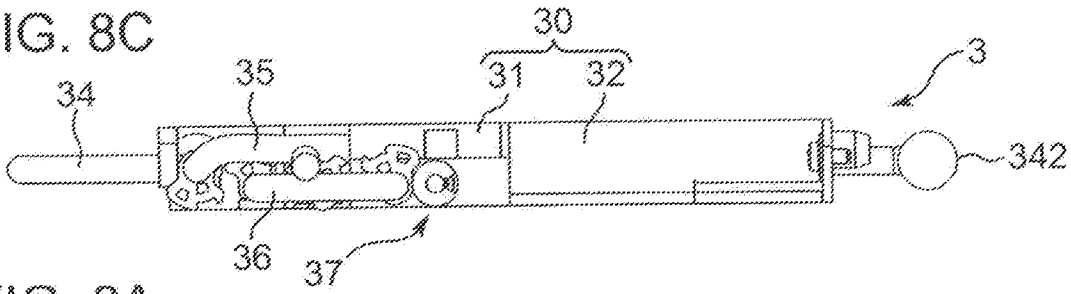
FIG. 8C is a top view of the liquid supply unit.
Figure 8A:
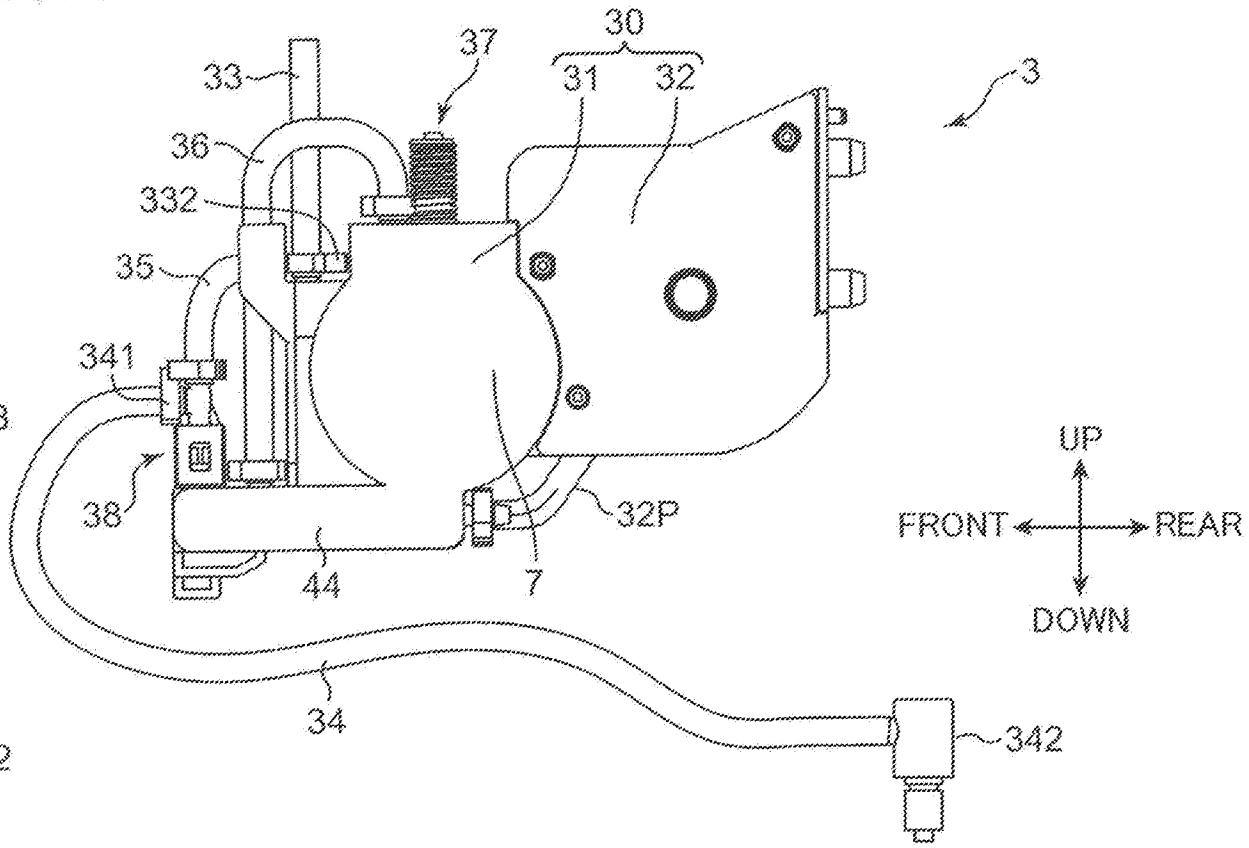
FIG. 8A is a front view of the liquid supply unit.
Figure 8B:
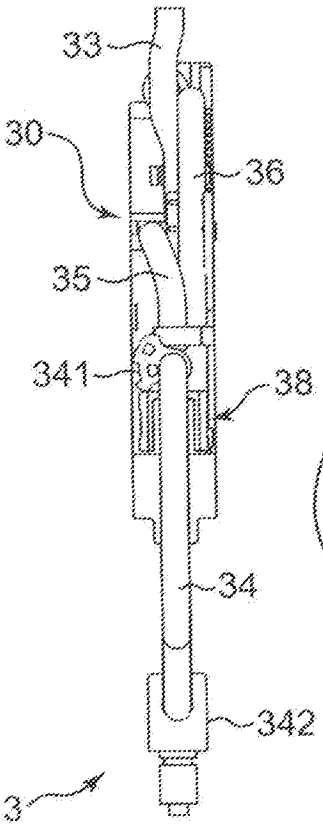
FIG. 8B is a side view of the liquid supply unit.
Figure 9:
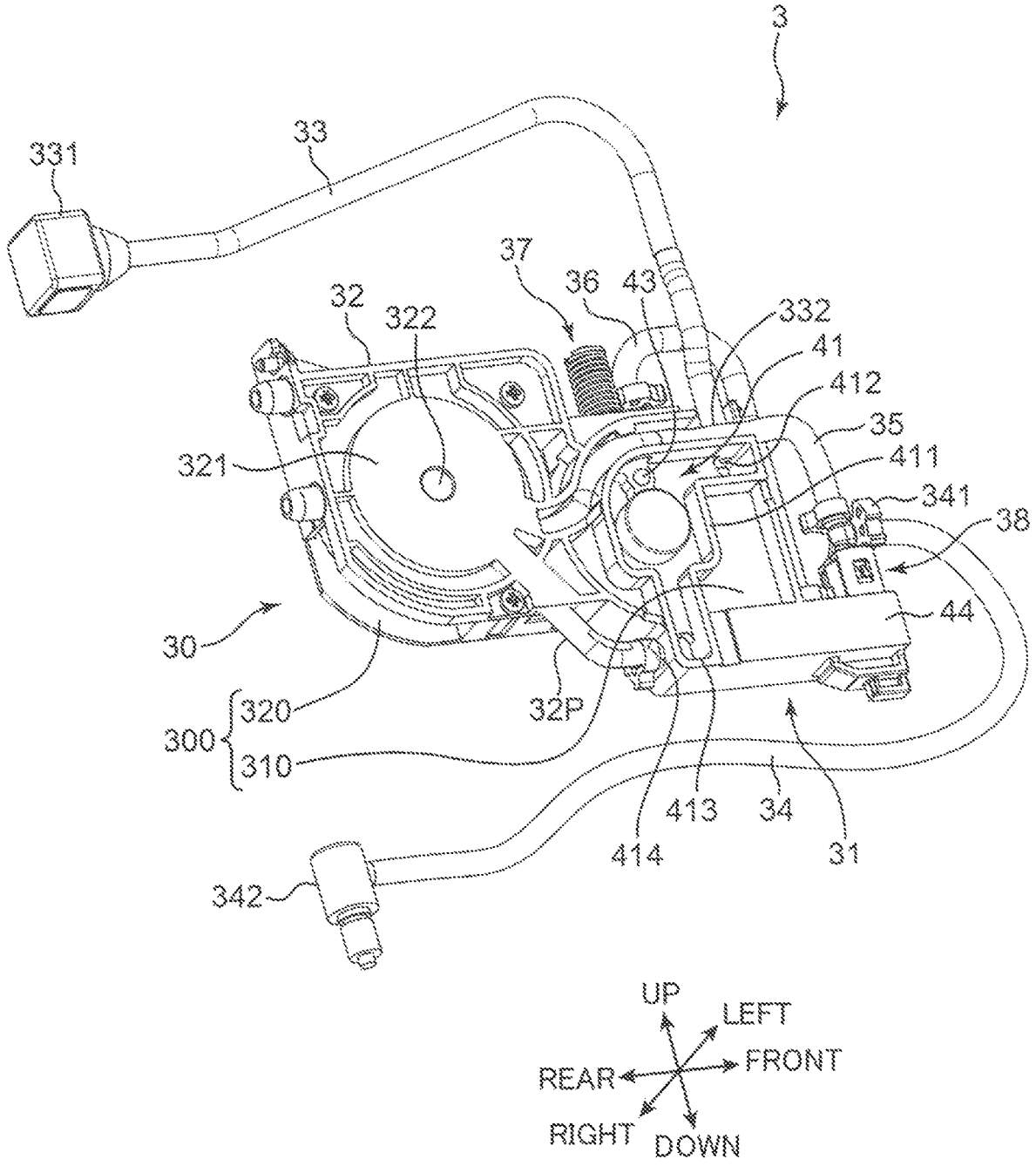
FIG. 9 is a perspective view showing an internal structure of the liquid supply unit.
Figure 10:
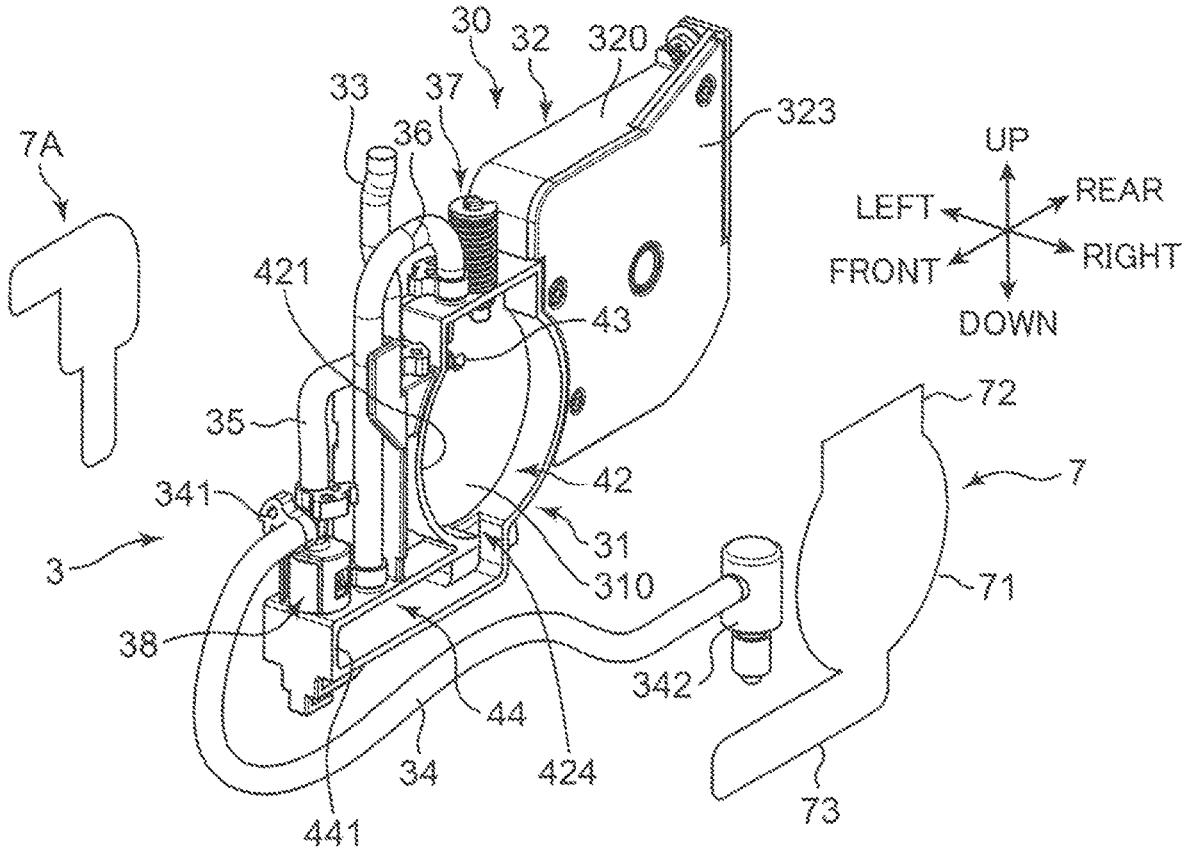
FIG. 10 is an exploded perspective view of the liquid supply unit.
Figure 11A:
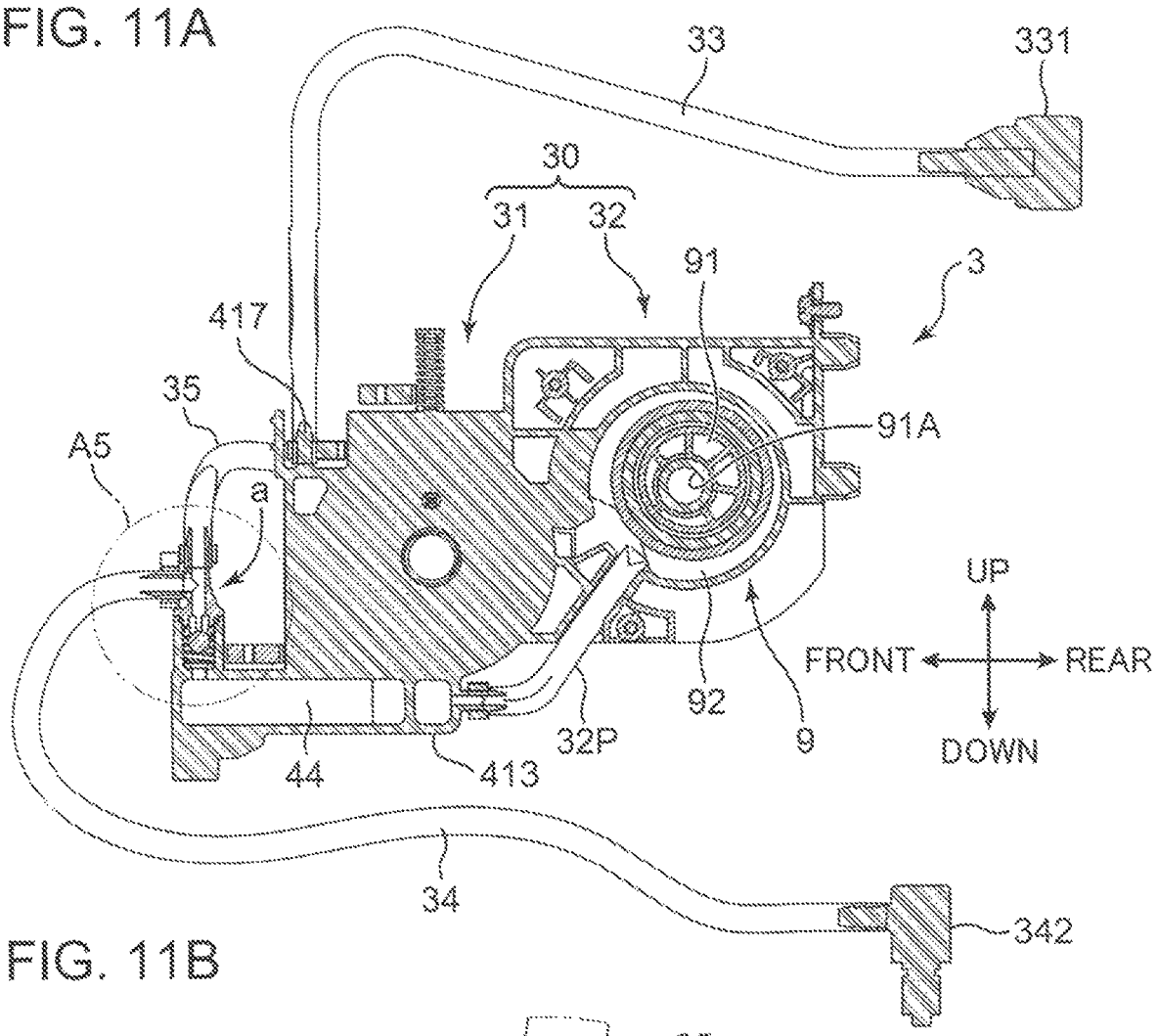
FIG. 11A is a sectional view showing a state of a backflow prevention mechanism in a print mode.
Figure 11B:
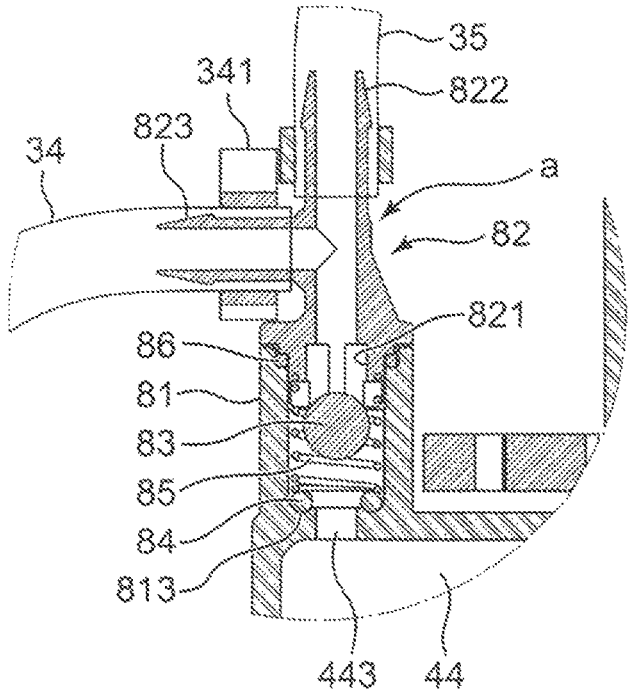
FIG. 11B is an enlarged view of a part A5 of FIG. 11A.

Next, the structure of the liquid supply unit 3 according to this embodiment which enables the execution of each mode of the liquid supply system described above is described in detail. FIG. 8A is a front view of the liquid supply unit 3, FIG. 8B is a side view thereof and FIG. 8C is a top view thereof. FIG. 9 is a perspective view showing an internal structure of the liquid supply unit 3 on the side of the first chamber 41. FIG. 10 is an exploded perspective view of the liquid supply unit 3 viewed from the side of the second chamber 42. FIG. 11A is a sectional view showing a state of the backflow prevention mechanism 38 in the print mode, and FIG. 11B is an enlarged view of a part A5 of FIG. 11A.

As preliminarily described on the basis of FIGS. 5 to 7B, the liquid supply unit 3 includes the body portion 30 having the tank portion 31 and the pump portion 32, the upstream pipe 33, the downstream pipe 34, the bypass pipe 35, the air vent mechanism 37, the backflow prevention mechanism 38, the transmitting member 5, the on-off valve 6 and the atmospheric pressure detection film 7. Besides these, the liquid supply unit 3 includes a monitor pipe 36 for monitoring an ink liquid surface in the second chamber 42, a communication pipe 32P allowing communication between the pump portion 32 and the first chamber 41 and a sealing film 7A constituting a part of a wall surface defining the first chamber 41.

The body portion 30 includes a base board 300 (FIG. 9) formed of a flat plate extending in the front-rear direction. A front side of the base board 300 is a tank portion base plate 310 (wall portion) serving as a board of the tank portion 31 and a rear side thereof is a pump portion housing 320 forming a housing structure in the pump portion 32. The first chamber 41 is arranged on a left surface side of the tank portion base plate 310, and the second chamber 42 is arranged on a right surface side thereof. The tank portion base plate 310 is perforated to form a communication opening 43 (FIG. 9) allowing communication between the first chamber 41 and the second chamber 42. The aforementioned on-off valve 6 (FIG. 6) is arranged in this communication opening 43.

As shown in FIG. 9, the first chamber 41 is roughly L-shaped in a side view. The first chamber 41 is defined by a first partition wall 411 projecting leftward from the tank portion base plate 310. An inflow opening 412 for the ink is perforated in an uppermost part of the first partition wall 411. An inflow port 417 (FIG. 11A) formed of a receiving plug stands on an outer side surface of the first partition wall 411 in correspondence with the inflow opening 412 for the ink. The downstream end 332 of the upstream pipe 33 is inserted and connected to this inflow port 417. That is, the inflow opening 412 is an opening allowing communication between the ink cartridge 1C and the first chamber 41, and the ink flows into the first chamber 41 through this inflow opening 412 by the water head difference.

A bottom wall portion 413 of the first partition wall 411 is located on the lower end of the tank portion base plate 310. A purge port 414 is provided in a rear side wall of the first partition wall 411 near the bottom wall portion 413. An upstream end of the communication pipe 32P is connected to this purge port 414.

The communication opening 43 is located in an upper end part of the first chamber 41. As already described, the first chamber 41 is a chamber in which the decompression process and the like are not performed and to which the pressure $P=\rho gh$ by the water head difference is applied in addition to the atmospheric pressure. When the ink flows through the inflow opening 412, the ink starts being pooled from the bottom wall portion 413. When an ink liquid level exceeds the communication opening 43, the ink can be supplied into the second chamber 42 through this communication opening 43. Further, when the pump 9 is operated, the ink stored in the first chamber 41 is sucked through the purge port 414 and the communication pipe 32P and the pressurized ink is supplied to the head unit 21 through the bypass pipe 35 and the downstream pipe 34.

With reference to FIG. 10, the second chamber 42 roughly has a circular shape in a plan view. The second chamber 42 is defined by a second partition wall 421 projecting rightward from the tank portion base plate 310. The second partition wall 421 includes a hollow cylindrical wall having a hollow cylindrical shape and an upper wall formed of a rectangular part projecting further upward than the hollow cylindrical wall.

A communication chamber 44 is connected to the lower end of the second chamber 42. The communication chamber 44 is a rectangular space elongated in the front-rear direction and extends straight forward from the lower end of the hollow cylindrical wall of the second partition wall 421. The communication chamber 44 is defined by a wall portion 441. A lower passage 424 allowing communication between the second chamber 42 and the communication chamber 44 is provided on the lower end of the hollow cylindrical wall of the second partition wall 421. The wall portion 441 is linked to the hollow cylindrical wall of the second partition wall 421 at the position of the lower passage 424. The communication chamber 44 is a space linking the second chamber 42 and the downstream pipe 34 and set to a negative pressure, and substantially constitutes a part of the second chamber 42.

One end of the monitor pipe 36 is connected to the upper end part of the second chamber 42 and the other end thereof communicates with the communication chamber 44. That is, the monitor pipe 36 communicates with upper and lower end sides of the second chamber 42 and the ink liquid level in the monitor pipe 36 is linked with that in the second chamber 42.

In this embodiment, the monitor pipe 36 is formed of a transparent resin tube. Accordingly, a user can know the ink liquid level in the second chamber 42 by seeing the monitor pipe 36. In this embodiment, as shown in FIG. 4, the plurality of liquid supply units 3 are arranged in parallel in the lateral direction in the carriage 2. Thus, even if a transparent film is used as the atmospheric pressure detection film 7 located on the right side surface, the liquid supply units 3 other than the one in a rightmost part cannot allow the ink liquid level in the second chamber 42 to be seen. However, in this embodiment, the monitor pipe 36 stands in front of the liquid supply unit 3. Thus, the user can know the ink liquid level in each second chamber 42 by seeing the monitor pipe 36 of each liquid supply unit 3 from the front of the carriage 2.

The backflow prevention mechanism 38 is installed on a top wall of the wall portion 441 near the front end of the communication chamber 44. The top wall of the wall portion 441 is perforated with a supply hole 443 (FIG. 11B) in correspondence with the backflow prevention mechanism 38. The upstream end 341 of the downstream pipe 34 is connected to the backflow prevention mechanism 38. The ink stored in the second chamber 42 is supplied to the downstream pipe 34 through the support hole 443 and the backflow prevention mechanism 38 by being sucked by the ink discharging portion 22. The backflow prevention mechanism 38 is described in detail later.

With reference to FIG. 10, an opening in a left surface side of the first chamber 41 is sealed by the sealing film 7A made of resin. The sealing film 7A has an outer shape matching a wall shape of the first partition wall 411 viewed from left. A peripheral edge part of the sealing film 7A is welded or adhered to an end surface of the first partition wall 411, whereby the sealing film 7A seals the opening of the first chamber 41.

An opening in a right surface side of the second chamber 42 is sealed by the atmospheric pressure detection film 7 made of a flexible resin film member (FIG. 10). The atmospheric pressure detection film 7 has an outer shape matching a wall shape of an integral assembly of the second partition wall 421 of the second chamber 42 and the wall portion 441 of the communication chamber 44. Specifically, the atmospheric pressure detection film 7 includes a body portion 71 corresponding to the hollow cylindrical wall of the second chamber 42, an upper extended portion 72 corresponding to the rectangular upper wall and a lower extending portion 73 corresponding to the wall portion 441 of the communication chamber 44. The atmospheric pressure detection film 7 seals the openings of the second chamber 42 and the communication chamber 44 by welding or adhering a peripheral edge part of the body portion 71 to an end surface of the hollow cylindrical wall, a peripheral edge part of the upper extending portion 72 to an end surface of the upper wall and a peripheral edge part of the lower extending portion 73 to an end surface of the wall portion 441. Note that the atmospheric pressure detection film 7 is welded or adhered without particular tension being applied thereto.

The pump portion 32 (FIG. 9) is arranged behind and adjacent to the tank portion 31 and includes a pump cavity 321 for housing the pump 9 and a cam shaft insertion hole 322 into which a cam shaft 93 (FIG. 4) for pivotally supporting an eccentric cam 91 (FIG. 11A) of the pump 9 is inserted. The pump cavity 321 is a hollow cylindrical cavity arranged at a center position of the pump portion housing 320 in the front-rear and vertical directions. The cam shaft insertion hole 322 is a boss hole provided at a position concentric with the pump cavity 321. An opening in a right surface side of the pump cavity 321 is sealed by a pump cover 323 (FIG. 10). As just described, in this embodiment, the pump cavity 321 is integrally provided to the tank portion base plate 310 serving as the base board of the tank portion 31, and the pump 9 for pressurized purging is mounted in the liquid supply unit 3 itself. In this way, the device configuration of the carriage 2 can be made compact and simple.

Next, the configuration of the backflow prevention mechanism 38 for preventing the pressurized ink from flowing back to the second chamber 42 when the pressurized purge mode described on the basis of FIG. 7A is performed is described. With reference to FIG. 11B, the backflow prevention mechanism 38 includes a valve conduit 81, a branched head portion 82, a spherical body 83, a sealing member 84, a coil spring 85 and an O-ring 86. The valve conduit 81 is a member integral with the top wall of the communication chamber 44 and the other components are mounted into the valve conduit 81.

The valve conduit 81 is a conduit extending in the vertical direction from the upper surface of the top wall of the wall portion 441. The valve conduit 81 provides an ink flow passage linking the communication chamber 44 and the downstream pipe 34 and constitutes a part of an ink supply passage from the second chamber 42 to the ink discharging portion 22.

The branched head portion 82 is a member for forming the joint part a described above on the basis of FIGS. 6, 7A and 7B. The branched head portion 82 includes a first inlet port 821, a second inlet port 822 and an outlet port 823. The first inlet port 821 is a port connected to the downstream end of the second chamber 42 and, in this embodiment, communicates with the second chamber 42 via the valve conduit 81 and the communication chamber 44. The second inlet port 822 is a port connected to the downstream end of the bypass pipe 35. The outlet port 823 is a port connected to the upstream end 341 of the downstream pipe 34. In the aforementioned print mode, the ink is supplied to the downstream pipe 34 through the first inlet port 821. On the other hand, in the pressurized purge mode, the ink is supplied to the downstream pipe 34 through the second inlet port 822.

The spherical body 83 is housed into the valve conduit 81 movably in the ink supply direction and works as a valve. An outer diameter of the spherical body 83 is smaller than an inner diameter of the valve conduit 81 and smaller than an inner diameter of the coil spring 85. Various materials can be used as a material for forming the spherical body 83, but the spherical body 83 is preferably formed of a material having a specific weight equal to or less than twice the specific weight of the ink. The spherical body 83 is immersed in the ink in the valve conduit 81. By approximating the specific weight of the spherical body 83 to that of the ink, an operating pressure of the spherical body 83 in the ink supply direction (vertical direction here) can be made smaller.

Generally, ink used in an ink jet printer is water-soluble solution and has a specific weight equal to or near 1. Thus, it is desirable to select a material having a specific weight less than 2 as the material of the spherical body 83. Further, the above material desirably has properties such as chemical resistance and wear resistance not to be deteriorated even if the material is constantly in contact with the ink. From these perspectives, it is particularly preferable to use polyacetal resin (specific weight≈1.5) as the material of the spherical body 83.

The sealing member 84 is a sealing component having a ring shape and to be seated on a seat portion 813 below the spherical body 83 and on a bottom wall of the valve conduit 81 (upper surface of the top wall of the wall portion 441), for example, as shown in FIG. 11B. A ring inner diameter (through hole) of the sealing member 84 is set smaller than the outer diameter of the spherical body 83, but larger than the supply hole 443 perforated in the top wall of the wall portion 441. When the spherical body 83 is separated from this sealing member 84, the valve conduit 81 is opened. On the other hand, when the spherical body 83 contacts the sealing member 84, the valve conduit 81 is closed.

The coil spring 85 is a compression spring mounted in the valve conduit 81 such that a lower end part thereof comes into contact with the sealing member 84 and an upper end part thereof comes into contact with a lower end edge of the first inlet port 821 of the branched head portion 82. The coil spring 85 biases the sealing member 84 toward the seat portion 813, whereby the sealing member 84 is constantly pressed into contact with the seat portion 813. Further, the spherical body 83 is housed inside the coil spring 85 and the coil spring 85 also functions to guide a movement of the spherical body 83 in the ink supply direction. Thus, a loose movement of the spherical body 83 in the valve conduit 81 can be restricted and a valve structure realized by movements of the spherical body 83 toward and away from the sealing member 84 can be stabilized.

The O-ring 86 seals butting parts of the valve conduit 81 and the branched head portion 82. The O-ring 86 is fit on the outer peripheral surface of the first inlet port 821.

FIG. 11A shows the pump 9 housed in the pump portion 32. The pump 9 is a tube pump including the eccentric cam 91 and a squeeze tube 92. The cam shaft 93 (FIG. 4) serving as an axis of rotation of the eccentric cam 91 is inserted into a shaft hole 91A of the eccentric cam 91. A rotational drive force is applied to this eccentric cam 91 from an unillustrated drive gear. The squeeze tube 92 is arranged on the peripheral surface of the eccentric cam 91 and squeezed by the rotation of the eccentric cam 91 around the cam shaft 93 to feed the liquid (ink) in the tube from one end side toward the other end side. In this embodiment, the squeeze tube 92 is a tube integral with the communication pipe 32P and the bypass pipe 35. Specifically, one end side of the squeeze tube 92 communicates with the bottom wall portion 413 of the first chamber 41 (communication pipe 32P), the other end side communicates with the second inlet port 822 of the branched head portion 82 (bypass pipe 35) and a central part serves as a squeezing portion arranged on the peripheral surface of the eccentric cam 91.

As described above, the pump 9 is stopped in the print mode shown in FIG. 6. In this case, the eccentric cam 91 is stopped by squeezing the squeeze tube 92, wherefore the ink supply passage passing through the bypass pipe 35 is closed. On the other hand, the pump 9 is driven in the forward rotation direction in the pressurized purge mode shown in FIG. 7A. In FIG. 11A, the forward rotation direction of the eccentric cam 91 is a counterclockwise direction. By this forward drive of the pump 9, the ink is sucked from the first chamber 41 through the communication pipe 32P and flows toward the backflow prevention mechanism 38, which is the joint part a, from the bypass pipe 35. Note that when the pump 9 is driven in the reverse rotation direction, the communication chamber 44, the second chamber 42 and the downstream pipe 34 are set to the negative pressure through the bypass pipe 35 and the branched head portion 82 as shown in FIG. 7B.

Next, the operation of the backflow prevention mechanism 38 is described. In the print mode, the ink is supplied to the head unit 21 along a supply route passing through the communication chamber 44, the backflow prevention mechanism 38 and the downstream pipe 34 from the second chamber 42. In such a print mode, the spherical body 83 is separated from the sealing member 84 and lifted upward as shown in FIG. 11B. This relies on the fact that the supply route from the second chamber 42 to the downstream pipe 34 is maintained at the negative pressure in the print mode. Coupled with the suction of the ink present in the supply route by the ink discharging portion 22 of the head unit 21 every time ink droplets are discharged, a force acts on the spherical body 83 in the ink supply direction and the spherical body 83 is lifted from the sealing member 84 in the liquid ink.

Since the spherical body 83 is separated from the sealing member 84, the supply hole 443 of the communication chamber 44 is opened. Thus, the ink can pass from the communication chamber 44 to the branched head portion 82.

On the other hand, in the pressurized purge mode, the ink pressurized through the bypass pipe 35 is supplied to the second inlet port 822 (joint part a) of the branched head portion 82 by the forward drive of the pump 9. Thus, the bypass pipe 35 and the downstream pipe 34 located downstream of the joint part a are pressurized by the pressurized ink. In this case, the ink is pressurized to a high pressure exceeding 100 kPa. If such a high pressure is applied to the second chamber 42, the atmospheric pressure detection film 7 defining a part of the second chamber 42 may be broken or a part thereof attached to the second partition wall 421 may be peeled off.

However, in this embodiment, the spherical body 83 is pressed downward (upstream side in the ink supply direction) to contact the sealing member 84 by a pressurizing force applied to the joint part a. By the contact of the spherical body 83 with the sealing member 84 pressed against the seat portion 813 by the coil spring 85, the supply hole 443 is closed. Specifically, out of the ink supply path in the print mode, the communication chamber 44 and the second chamber 42 located upstream of the joint part a are blocked from pressurization by the pressurized ink. Thus, the breakage of the atmospheric pressure detection film 7 and the like can be prevented.

Figure 12:
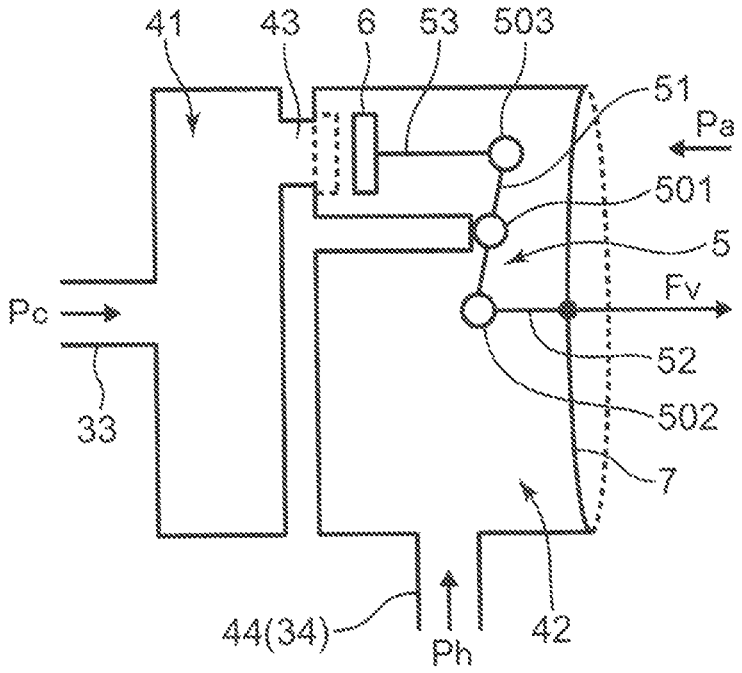
FIG. 12 is a diagram showing the structure and function of a transmitting member inside the liquid supply unit according to one embodiment of the present disclosure.
Figure 13:
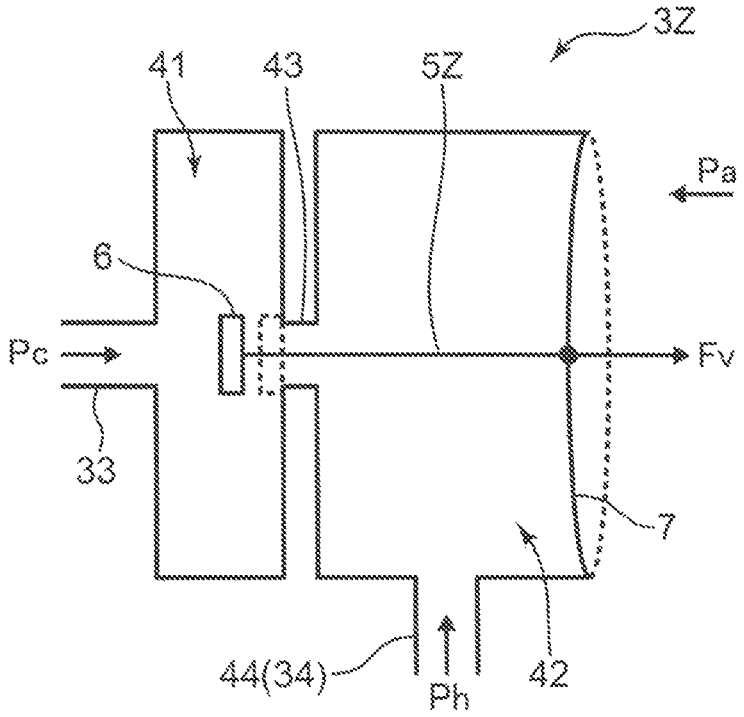
FIG. 13 is a diagram showing the structure and function of a transmitting member inside another liquid supply unit to be compared to the liquid supply unit according to the one embodiment of the present disclosure.

FIG. 12 is a diagram showing the structure and function of the transmitting member 5 inside the liquid supply unit 3 according to this embodiment. FIG. 13 is a diagram showing the structure and function of a transmitting member 5Z inside another liquid supply unit to be compared to the liquid supply unit 3 according to this embodiment. With reference to FIG. 12, the liquid supply unit 3 supplies the ink from the ink cartridge IC storing the predetermined ink (liquid) to the head unit 21 (liquid injection head) for injecting the ink in this embodiment as described above. Here, the liquid supply unit 3 includes the tank portion 31 having the first and second chambers 41, 42, the on-off valve 6, the atmospheric pressure detection film 7 and the transmitting member 5. The first chamber 41 communicates with the ink cartridge IC. The second chamber 42 is arranged downstream of the first chamber 41 in the liquid supply direction and communicates with the head unit 21. The tank portion base plate 310 of the tank portion 31 is formed with the communication opening 43 allowing communication between the first and second chambers 41, 42. The on-off valve 6 is arranged to be able to open and close the communication opening 43 from the side of the second chamber 42, and changes the posture thereof between the closing posture for closing the communication opening 43 and the opening posture for opening the communication opening 43. Further, the atmospheric pressure detection film 7 defines a side surface of the second chamber 42 facing the communication opening 43 and is displaced based on a pressure change of the second chamber 42.

With reference to FIG. 12, the transmitting member 5 is arranged inside the second chamber 42. The transmitting member 5 transmits a displacement force of the atmospheric pressure detection film 7 to the on-off valve 6 in a direction opposite to a displacement direction of the atmospheric pressure detection film 7.

The transmitting member 5 includes a link portion 51, a first connecting portion 52 and a second connecting portion 53. The link portion 51 is supported in the second chamber 42 to be rotatable about a link pivot portion 501. In other words, an upper end side of the link portion 51 extends upward from the link pivot portion 501 and a lower end side of the link portion 51 extends downward from the link pivot portion 501. In this embodiment, the link portion 51 is formed of a rod-like member. The first connecting portion 52 connects one end side (lower end part) of the link portion 51 and a back surface part (inner surface part) of the atmospheric pressure detection film 7. On the other hand, the second connecting portion 53 connects the other end side (upper end part) of the link portion 51 and the on-off valve 6. Note that a base end part of the first connecting portion 52 is rotatably supported on the link portion 51 at a film-side pivot portion 502, and a base end part of the second connecting portion 53 is rotatably supported on the link portion 51 at a valve-side pivot portion 503.

As described above, the second chamber 42 is set to the negative pressure when the ink is normally supplied. When the ink is consumed in the head unit 21, the ink is supplied (sucked) from the second chamber 42 to the head unit 21. At this time, the atmospheric pressure detection film 7 is displaced inwardly of the second chamber 42 to move from a broken line to a solid line of FIG. 12. On the other hand, the transmitting member 5 transmits a displacement force of the atmospheric pressure detection film 7 to set the on-off valve 6 to the opening posture when the second chamber 42 is set to a negative pressure exceeding a predetermined threshold value according to such a decrease of the ink in the second chamber 42. Specifically, if the atmospheric pressure detection film 7 is displaced inwardly of the second chamber 42, the link portion 51 rotates clockwise in FIG. 12 with the link pivot portion 501 serving as a pivot point. As a result, the on-off valve 6 moves from a broken line position to a solid line position of FIG. 12 to open the communication opening 43 while being pulled by the second connecting portion 53. Thus, the ink flows from the first chamber 41 into the second chamber 42. As just described, in this embodiment, the posture of the on-off valve 6 can be changed at a desired timing and the stable supply of the ink to the head unit 21 can be ensured.

On the other hand, the pressurized purge mode is performed in the liquid supply unit 3 (FIG. 7A) as described above. At this time, even if the pressure in the downstream pipe 34 reaches a high pressure, a large increase of the pressure in the second chamber 42 is suppressed by the action of the backflow prevention mechanism 38 (FIGS. 7A and 7B). Further, even if the spherical body 83 (FIG. 11B) of the backflow prevention mechanism 38 erroneously operates, the transmitting member 5 prevents a backflow of the ink from the second chamber 42 to the first chamber 41. Specifically, if high-pressure ink flows from the communication chamber 44 into the second chamber 42 in FIG. 12, the atmospheric pressure detection film 7 is displaced outward from the solid line position to the broken line position. As a result, the first connecting portion 52 is pulled by the atmospheric pressure detection film 7, and the link portion 51 rotates counterclockwise with the link pivot portion 501 serving as a pivot point. Then, the second connecting portion 53 presses the on-off valve 6 to the closing posture and the communication opening 43 is sealed by the on-off valve 6. Specifically, the transmitting member 5 transmits the displacement force of the atmospheric pressure detection film 7 to the on-off valve 6 to set the on-off valve 6 to the closing posture according to a displacement of the atmospheric pressure detection film 7 when the second chamber 42 is pressurized. Thus, when the second chamber 42 is erroneously pressurized, the on-off valve 6 is reliably set to the closing posture and a backflow of the ink from the second chamber 42 to the first chamber 41 is suppressed. Further, since the transmitting member 5 has a link structure in this embodiment, the displacement of the atmospheric pressure detection film 7 can be reliably transmitted to the on-off valve 6.

Note that it is defined in FIG. 12 that Pc denotes the pressure of the ink supplied from the upstream pipe 33 to the first chamber 41, Ph denotes the pressure of the pressurized ink supplied from the downstream pipe 34 to the second chamber 42, Pa denotes the atmospheric pressure, sv denotes a cross-sectional area of the communication opening 43, s denotes a cross-sectional area of the atmospheric pressure detection film 7 and Fv denotes a force applied to the atmospheric pressure detection film 7. At this time, a pressure difference ΔPv between the inside and outside of the second chamber 42 having the atmospheric pressure detection film 7 as a boundary is expressed by Equation 1.

$$\Delta Pv = Fv/s = Pa - Ph \quad \text{(Equation 1)}$$

From Equation 1, a relationship of the pressures Ph, Pa is expressed by Equation 2.

$$Ph = Pa - Fv/s \quad \text{(Equation 2)}$$

Further, a force Fa for opening the on-off valve 6 is expressed by Equation 3.

$$Fa = (Pc - Ph) \times sv \quad \text{(Equation 3)}$$

Further, a force Fb of the transmitting member 5 to seal the on-off valve 6 is expressed by Equation 4.

$$Fb = Fv - (Pa - Ph) \times s \quad \text{(Equation 4)}$$

Specifically, the on-off valve 6 is held in the closing posture if $Fa \ll Fb$.

On the other hand, a case where the on-off valve 6 is arranged on the side of the first chamber 41 and the transmitting member 5Z directly connects the on-off valve 6 and the atmospheric pressure detection film 7 is assumed with reference to FIG. 13. If high-pressure ink flows from the communication chamber 44 into the second chamber 42 in such a configuration, the on-off valve 6 is opened due to a pressure difference between the second chamber 42 and the first chamber 41. Thus, even if the atmospheric pressure detection film 7 applies a force for pulling the on-off valve 6, the ink may flow back from the second chamber 42 to the first chamber 41 through the communication opening 43. On the other hand, in this embodiment, the transmitting member 5 configured to open the on-off valve 6 according to need when the ink is normally supplied has a function of reliably closing the on-off valve 6 even if a malfunction occurs in the pressurized purge mode.

Modification

The one embodiment of the present disclosure has been described above. According to the liquid supply unit 3 and the printer 1 thus described, the transmitting member 5 can reliably operate and the ink can be timely supplied to the second chamber 42 when the ink is supplied by the water head difference. Note that the present disclosure is not limited to this and, for example, the following modifications can be employed.

(1) Although the first chamber 41 is arranged upstream of the communication opening 43 in FIG. 12 in the above embodiment, the upstream pipe 33 may directly communicate with the upstream side of the communication opening 43.

(2) Although the liquid supply unit 3 includes the pump portion 32 in the above embodiment, the pump portion 32 may be fixed to the apparatus body 11 without being arranged in the liquid supply unit 3 (carriage 2).

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A liquid supply unit for supplying predetermined liquid from a liquid storage container storing the liquid to a liquid injection head for injecting the liquid, comprising:

a first chamber communicating with the liquid storage container;

a second chamber arranged downstream of the first chamber in a liquid supply direction and communicating with the liquid injection head;

a wall portion including a communication opening allowing communication between the first chamber and the second chamber;

an opening/closing member arranged to be able to open and close the communication opening from the second chamber side and configured to change a posture between a closing posture for closing the communication opening and an opening posture for opening the communication opening;

a flexible film member defining a side surface of the second chamber facing the communication opening and configured to be displaced based on a pressure change of the second chamber; and a transmitting member configured to transmit a displacement force of the flexible film member to the opening/closing member in a direction opposite to a displacement direction of the flexible film member, the transmitting member transmitting the displacement force to the opening/closing member to set the opening/closing member to the opening posture when the second chamber is set to a negative pressure exceeding a predetermined threshold value as the liquid in the second chamber decreases and transmitting the displacement force to the opening/closing member to set the opening/closing member to the closing posture according to a displacement of the flexible film member when the second chamber is pressurized.

2. A liquid supply unit according to claim 1, wherein:

the transmitting member includes:

a link portion supported in the second chamber rotatably about a predetermined pivot point;

a first connecting portion configured to connect one end side of the link portion and the flexible film member; and a second connecting portion configured to connect the other end side of the link portion arranged on a side opposite to the one end side with respect to the pivot point and the opening/closing member; and the first connecting portion is pulled by the flexible film member and the link portion rotates about the pivot point when the second chamber is pressurized, whereby the second connecting portion presses the opening/closing member to set the opening/closing member to the closing posture.

3. A liquid supply unit according to claim 1, wherein:

the liquid storage container is arranged above the liquid injection head;

the liquid supply unit is arranged between the liquid storage container and the liquid injection head and supplies the liquid to the liquid injection head by a water head difference;

the second chamber is set to a negative pressure when the liquid is normally supplied; and the opening/closing member is set to the opening posture and the liquid flows from the first chamber into the second chamber through the communication opening when the second chamber is set to a negative pressure exceeding the predetermined threshold value as the liquid in the second chamber decreases.

4. A liquid injection device, comprising:

a liquid injection head configured to inject predetermined liquid;

a liquid supply unit according to claim 1 configured to supply the liquid from a liquid storage container storing the liquid to the liquid injection head;

a first supply passage allowing communication between the liquid storage container and the first chamber of the liquid supply unit; and a second supply passage allowing communication between the liquid injection head and the second chamber of the liquid supply unit.

* * * * *